US006537157B1

(12) United States Patent
Dziura et al.

(10) Patent No.: US 6,537,157 B1
(45) Date of Patent: Mar. 25, 2003

(54) PIT BOARD FOR BOWLING ALLEYS AND METHOD FOR MAKING THE SAME

(75) Inventors: Edward J. Dziura, Montague, MI (US); Ted E. Brim, Grand Haven, MI (US)

(73) Assignee: Brunswick Bowling & Billiards Corporation, Muskegon, MI (US)

( * ) Notice: Subject to any disclaimer, the term of this patent is extended or adjusted under 35 U.S.C. 154(b) by 0 days.

(21) Appl. No.: 09/999,845

(22) Filed: Oct. 24, 2001

(51) Int. Cl.[7] ..... A63D 5/00
(52) U.S. Cl. ..... 473/54; 473/93
(58) Field of Search ..... 473/54, 106, 73, 473/90, 93

(56) References Cited

U.S. PATENT DOCUMENTS

| | | | |
|---|---|---|---|
| 2,205,802 | A | 6/1940 | Scheidemantel et al. |
| 3,188,085 | A | 6/1965 | Rogers et al. |
| 3,526,401 | A | 9/1970 | Zuercher |
| 3,751,036 | A | 8/1973 | Bockelman |
| 3,880,424 | A | 4/1975 | Bockelman |
| 4,426,078 | A | 1/1984 | Alonzo |
| 5,238,242 | A | 8/1993 | Edwards |
| 5,330,412 | A | 7/1994 | Stephens |
| 5,447,473 | A | 9/1995 | Scripps |
| 5,536,211 | A | 7/1996 | Kelly |
| 5,876,290 | A | 3/1999 | Hermanson et al. |

*Primary Examiner*—William M. Pierce
(74) *Attorney, Agent, or Firm*—Price, Heneveld, Cooper, DeWitt & Litton

(57) ABSTRACT

A unique pit board is designed for bowling alleys of the type having a pit conveyor assembly with a shaker mechanism to convey downed pins to an associated pinsetter, and comprises top and bottom shell members constructed from a synthetic resin material. The top shell member has a formed upper surface which is inclined downwardly toward a marginal portion to convey downed pins to an adjacent pinsetter. The bottom shell member has formed reinforcing ribs to rigidify the same. The top and bottom shell members are interconnected in an overlying relationship to provide a very rigid, lightweight construction. A mounting member connects the pit board directly to the shaker mechanism without any intermediate frame.

39 Claims, 6 Drawing Sheets

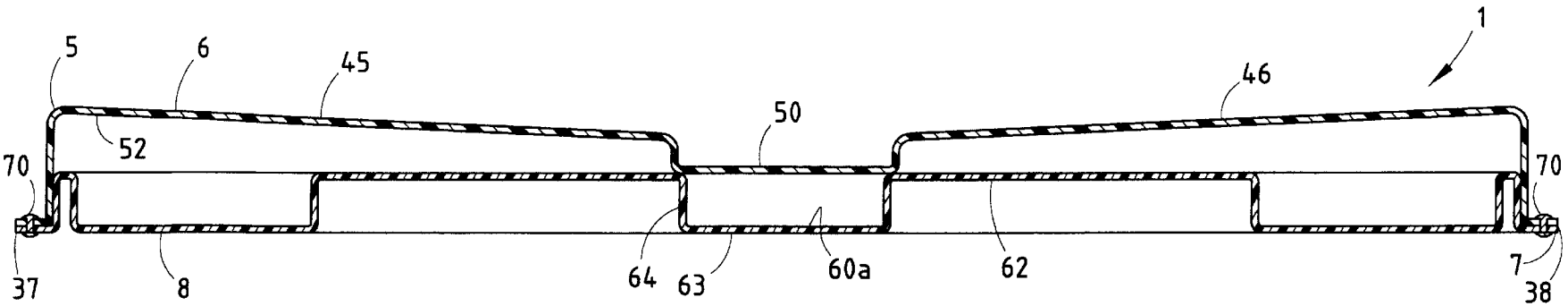
FIG. 5
FIG. 8
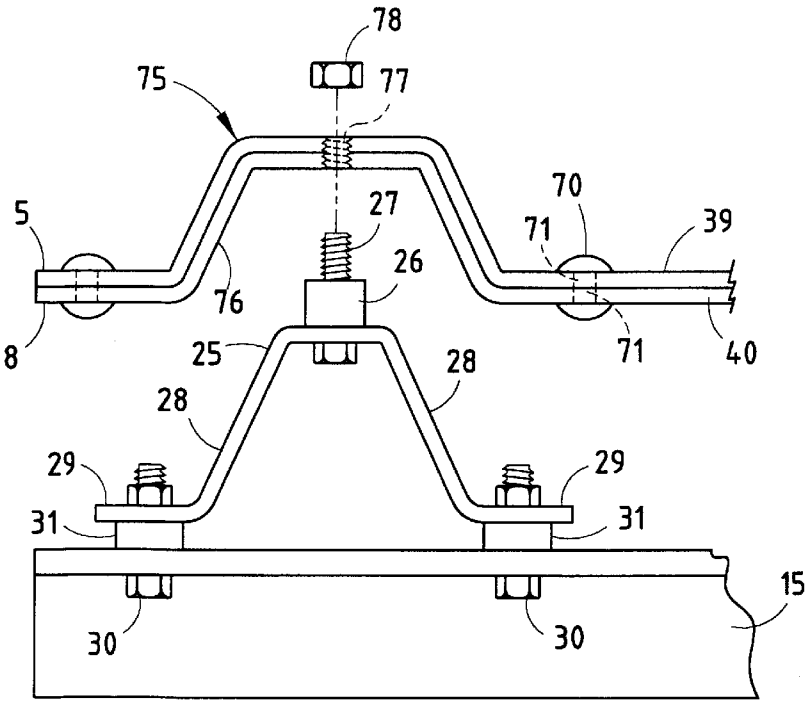

PIT BOARD FOR BOWLING ALLEYS AND METHOD FOR MAKING THE SAME

BACKGROUND OF THE INVENTION

The present invention relates to pit conveyor assemblies for bowling alleys and the like, and in particular to a unique pit board and method for making the same.

Pit conveyor assemblies are generally well known in the art of bowling, and are designed to convey downed bowling pins to an associated pinsetter. While some types of pit conveyor assemblies, such as those disclosed in U.S. Pat. Nos. 3,526,401; 5,238,242; and 5,330,412 to AMF Bowling Inc., employ a moving, endless belt to move downed pins to the pinsetter, other types of pit conveyor assemblies, such as those disclosed in U.S. Pat. No. 2,949,300 to Brunswick Corporation, employ a shaker mechanism to move downed bowling pins to the pinsetter.

Heretofore, shaker actuated pin conveyor assemblies typically include a bottom pit conveyor frame that is anchored to the floor of the pit area directly behind the pin deck, and supports a rotating vibrator shaft. A top pit conveyor frame is positioned directly above the lower pit conveyor frame, and is movably supported thereon by flexible mounts which permit horizontal reciprocation of the top pit conveyor frame. A linkage mechanism operably connects the vibrator shaft to the upper pit conveyor frame to vibrate the same along a horizontal plane when the vibrator shaft rotates. A flat pit board with upturned rear corners is attached to the top of the upper pit conveyor frame, and is inclined to the rear to move downed bowling pins to the pinsetter. A removable pit carpet cover is positioned over the top of the pit board, and can be detached for cleaning and/or replacement.

While such pit conveyor assemblies are generally quite effective in moving downed bowling pins to the pinsetter, they have a rather complex construction, which adds to manufacturing and installation costs, and are not particularly easy to keep clean and/or maintain. The lane conditioning oil and dirt attracted thereby builds up rather quickly not only on the pit carpet cover, but also on the top and bottom frames, as well as the other moving parts of the shaker mechanism. Consequently, the pit board and attached upper pit conveyor frame must be removed on a regular basis to access the interior of the pit conveyor assembly and permit thorough cleaning of the lower pit conveyor frame and associated vibrator shaft, linkage mechanisms, etc. and to lubricate the moving parts.

Furthermore, the combined weight of the upper pit conveyor frame, pit board and pit carpet is rather substantial, which increases the difficulty associated with removal of the same for cleaning and maintenance as noted above. Also, because the relatively heavy assembly is constantly vibrated to convey downed bowling pins to the pinsetter, substantial wear results in the shaker mechanism and associated linkages. The weight of the heavy assembly also requires substantial energy to operate.

SUMMARY OF THE INVENTION

One aspect of the present invention is a pit conveyor assembly for bowling alleys and the like of the type having a shaker mechanism to convey downed pins to an associated pinsetter. An improved pit board is provided, comprising a top shell member constructed from a synthetic material, and having a formed upper surface which is inclined downwardly toward a marginal portion thereof to convey downed bowling pins to an adjacent pinsetter. The pit board also includes a bottom shell member constructed from a synthetic resin material, and having formed reinforcing ribs to rigidify the bottom shell member. The top shell member and bottom shell member are interconnected in an overlying relationship to provide a rigid, lightweight construction. A mounting member connects the pit board directly to the shaker mechanism without any intermediate frame.

Yet another aspect of the present invention is a pit board for bowling alleys and the like of the type having a pit conveyor assembly with a shaker mechanism to convey downed bowling pins to an associated pinsetter. The pit board comprises a top shell member constructed from a synthetic resin material, and having a formed upper surface which is inclined downwardly toward a marginal portion thereof to convey downed pins to an adjacent pinsetter. The pit board also includes a bottom shell member constructed from a synthetic resin material, and having-formed reinforcing ribs to rigidify the bottom shell member. The top shell member and bottom shell member are interconnected in an overlying relationship to provide a rigid, lightweight construction. A mounting member is provided to connect the pit board directly to the shaker mechanism without any intermediate frame.

Yet another aspect of the present invention is a method for making a pit conveyor assembly for bowling alleys and the like of the type having a shaker mechanism to convey downed bowling pins to an associated pinsetter. The method comprises molding from a synthetic resin material a top shell member by forming an upper surface which is inclined downwardly toward a marginal portion thereof to convey downed bowling pins to an adjacent pinsetter. The method also includes molding from a synthetic resin material a bottom shell member by forming reinforcing ribs to rigidify the bottom shell member. The top shell member and bottom shell member are interconnected in an overlying relationship to form a rigid, lightweight, one-piece, frameless pit board that is attached directly to the shaker mechanism without any intermediate frame.

Yet another aspect of the present invention is a method for making a pit board for bowling alleys and the like of the type having a pit conveyor assembly with a shaker mechanism to convey downed bowling pins to an associated pinsetter. The method comprises molding from a synthetic resin material a top shell member by forming an upper surface which is inclined downwardly toward a marginal portion thereof to convey downed pins to an adjacent pinsetter. The method also includes molding from a synthetic resin material a bottom shell member by forming reinforcing ribs to rigidify the bottom shell member. The top shell member and bottom shell member are interconnected in an overlying relationship to create a rigid, lightweight, clamshell construction. The method further comprises forming a mounting member that attaches the pit board directly to the shaker mechanism without any intermediate frame.

The principal objects of the present invention are to provide a unique lightweight pit board that can be attached directly to an associated shaker mechanism without any intermediate frame. The pit board is made from synthetic top and bottom shell members, which when interconnected in an overlying relationship, define a very rigid, one-piece, enclosed, clamshell construction that alleviates dirt collection and facilitates cleaning. The pit board has an uncomplicated construction which is economical to manufacture and install. Furthermore, the pit board has a very lightweight construction that facilitates installation and removal, alleviates wear on moving parts, and reduces energy consumption during operation.

These and other advantages of the invention will be further understood and appreciated by those skilled in the art by reference to the following written specification, claims and appended drawings.

BRIEF DESCRIPTION OF THE DRAWINGS

FIG. 5 is a vertical cross-sectional view of the pit board taken along the line VV, FIG. 1.

FIG. 8 is an enlarged, fragmentary exploded view of a mounting portion of the pit board and an adjacent corner of the pit conveyor assembly.

DETAILED DESCRIPTION OF THE PREFERRED EMBODIMENTS

Figure 6:
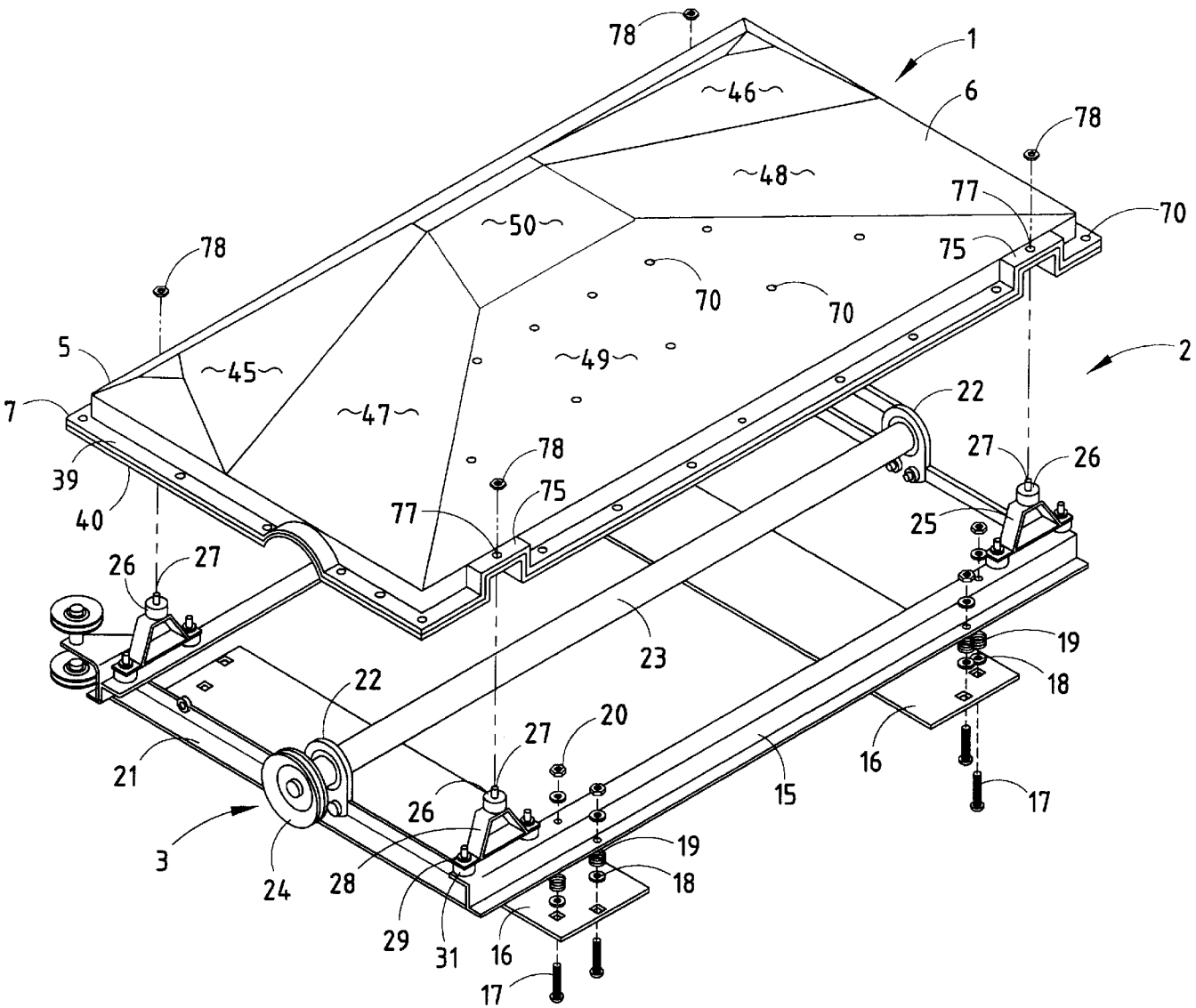
FIG. 6 is an exploded perspective view of the pit board and an associated pit conveyor assembly shown in a disassembled condition.
Figure 7:
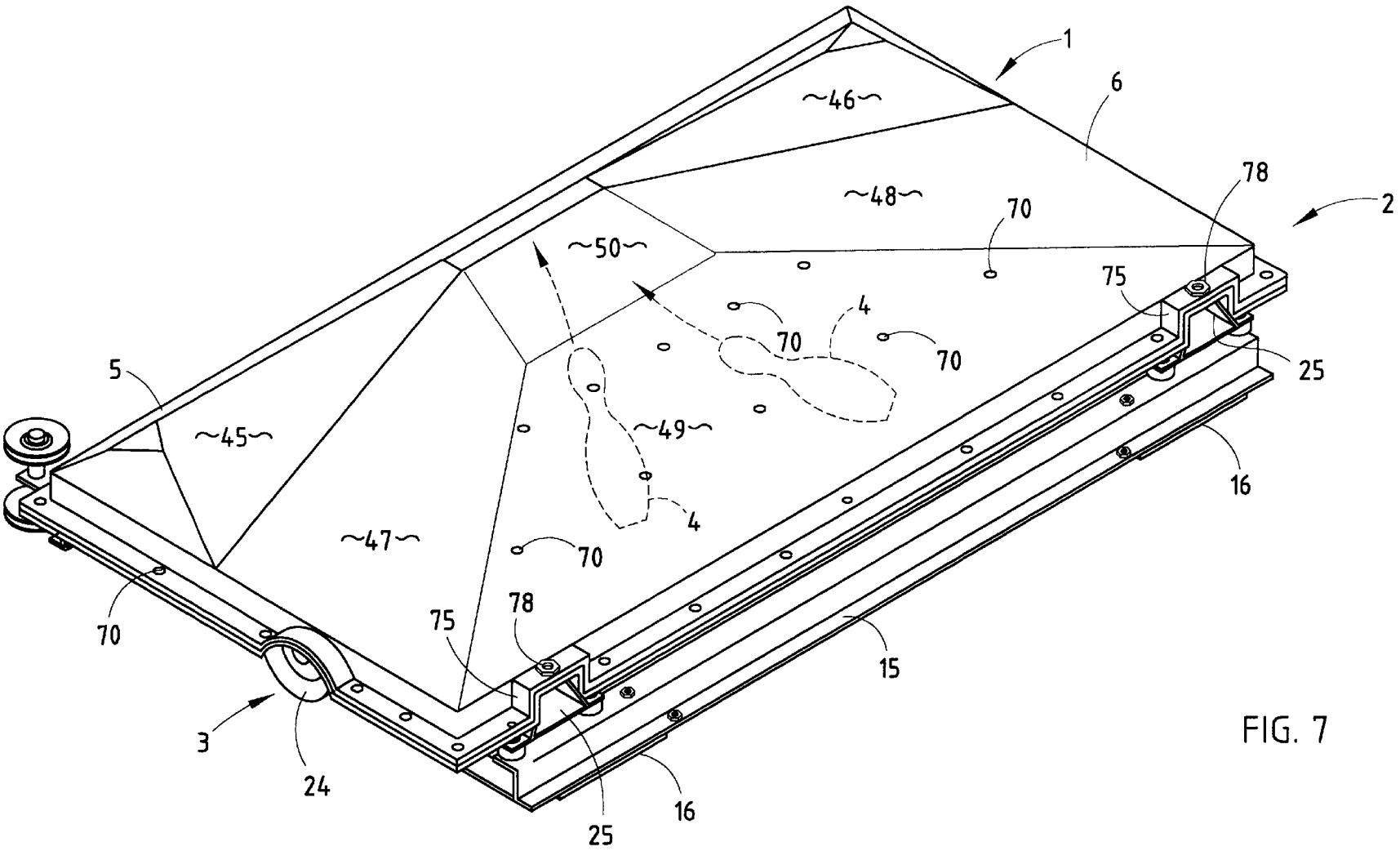
FIG. 7 is a perspective view of the pit board and associated pit conveyor assembly shown in an assembled condition.

For purposes of description herein the terms "upper", "lower", "right", "left", "rear", "front", "vertical", "horizontal" and derivatives thereof shall relate to the invention as oriented in FIGS. 6 and 7. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
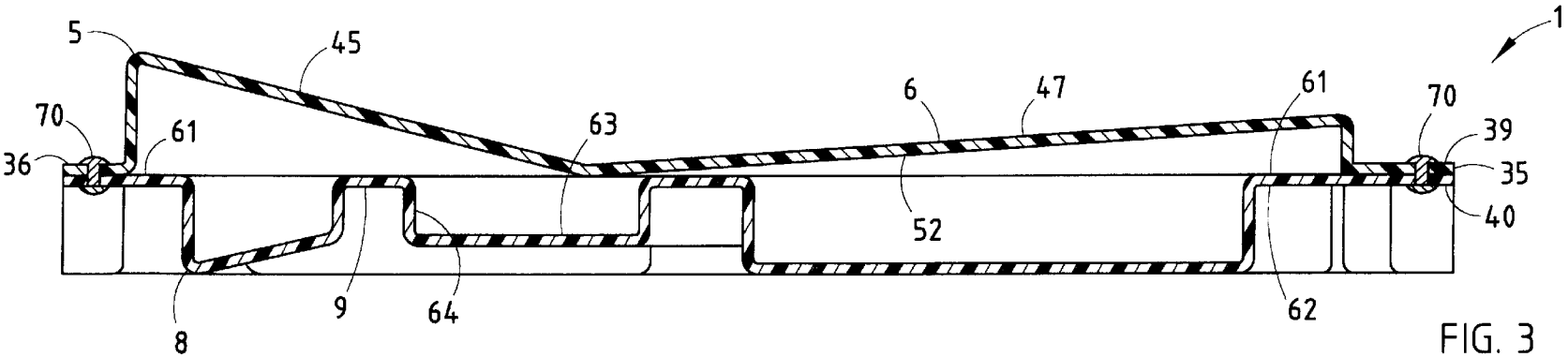
FIG. 3 is an enlarged vertical cross-sectional view of the pit board taken along the line III III, FIG. 1.
Figure 4:
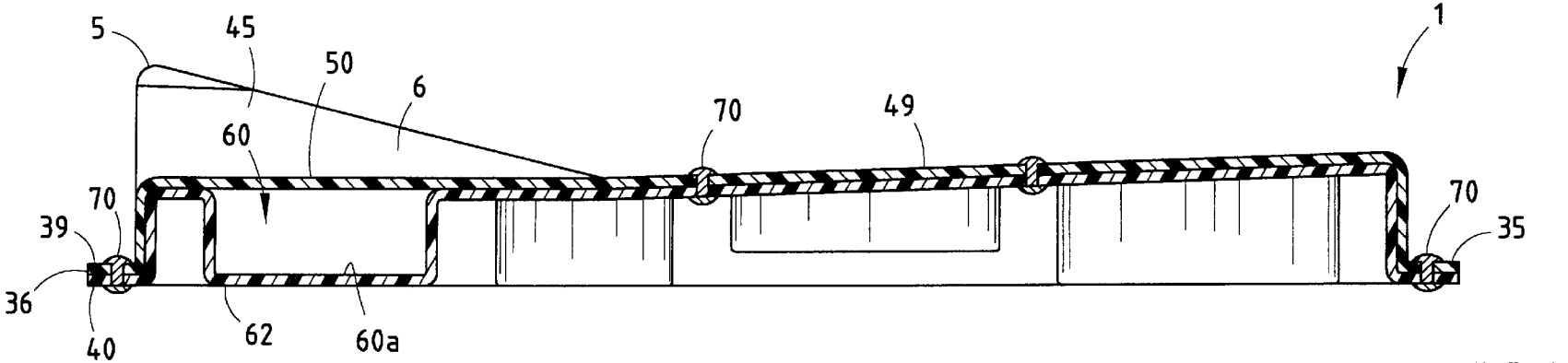
FIG. 4 is an enlarged vertical cross-sectional view of the pit board taken along the line IV IV, FIG. 1.

The reference numeral 1 (FIG. 1) generally designates a pit board embodying the present invention. Pit board 1 is designed for bowling alleys of the type having a pit conveyor assembly 2 (FIGS. 6 and 7) with a shaker mechanism 3 to convey downed bowling pins 4 to an adjacent pinsetter (not shown). Pit board 1 comprises a top shell member 5 (FIG. 1) having a formed upper surface 6 which is inclined downwardly toward a marginal portion 7 to convey downed bowling pins 4 to the pinsetter (not shown). Pit board 1 also includes a bottom shell member 8 (FIG. 2) constructed from a synthetic resin material, and having formed reinforcing all) ribs 9 to rigidify the same. Top shell member 5 and bottom shell member 8 are interconnected in an overlying relationship, as shown in FIGS. 3–5, to provide a rigid, lightweight construction. Pit board 1 is connected directly to shaker mechanism 3 without any intermediate frame.

With reference to FIGS. 6 and 7, pit board 1 is designed for use with the illustrated pit conveyor assembly 2 of the type that includes shaker mechanism 3. Pit conveyor assembly 2 is of the type disclosed in the "Genuine Brunswick Parts Catalog" publication incorporated herein, and includes a bottom pit conveyor frame 15 having mounting plates 16 for anchoring the same to the bottom of an associated pit by bolts 17, washers 18 and 19, and lock nuts 20. Bottom pit conveyor frame 15 includes side jogger links 21 which support vibrator shaft bearing and housing assemblies 22. A vibrator shaft 23 extends laterally across pit conveyor assembly 2 and is rotatably supported in bearing and housing assemblies 22. One end of vibrator shaft 23 includes a vibrator shaft drive pulley 24, which is used to rotate vibrator shaft 23, and thereby actuates shaker mechanism 3. Four flexible mounts 25 are attached to bottom pit conveyor frame 15 adjacent the corners thereof, and each includes a pair of lower rubber grommet 31, and an upper rubber grommet 26 on the upper surface thereof through which a threaded mounting stud 27 projects. As best shown in FIG. 8, the illustrated flexible mounts 25 have inclined side arms 28 with flat feet 29 supported on the tops of lower rubber grommets 26, and attached to the bottom pit conveyor frame 15 by threaded fasteners 30.

In the shaker type prior art pit conveyor assemblies discussed above, bottom pit conveyor frame 15 supports a top pit conveyor frame assembly, which in turn supports a flat pit board with upturned rear corners, as well as a pit carpet that may be covered by a pit carpet cover (not shown). In the present invention, pit board 1 replaces the prior top pit conveyor frame and board with a one-piece unit that is substantially lighter and easier to clean than in prior art mechanisms.

With reference to FIGS. 1–5, the illustrated pit board 1 has a generally rectangular plan configuration, comprising a front edge 35, a rear edge 36 and opposite side edges 37 and 38. Both the top shell member 5 and bottom shell member 8 are formed from imperforate sheets of synthetic resin material, and include outwardly extending peripheral flanges 39 and 40 which are interconnected in the manner described in greater detail thereinafter, to create an enclosed, one-piece, clamshell type of construction that greatly alleviates dirt collection and facilitates cleaning.

Figure 1:
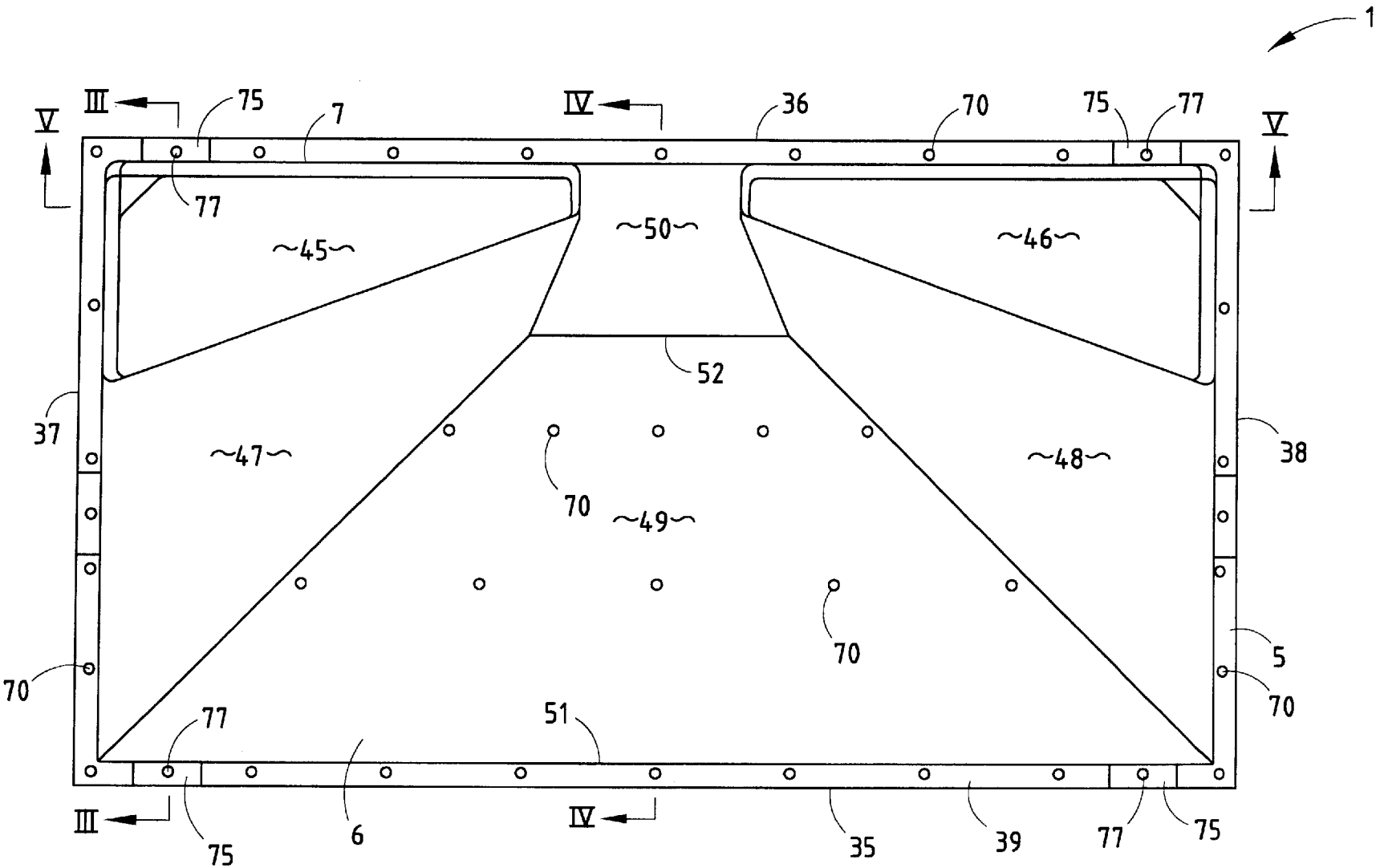
FIG. 1 is a top plan view of a pit board embodying the present invention.

As best shown in FIG. 1, the upper surface 6 of the illustrated top shell member 5 is formed with significant contours to assist in conveying downed bowling pins 4 to the pinsetter, and has five distinct surfaces 45–49 which are sloped or inclined downwardly toward a central exit ramp 50 adjacent the rear edge 36 of pit board 1. The forward surface 49 of top shell member 5 has a generally trapezoidal plan configuration, with the forward side 51 thereof extending along front edge 35, and the rear side 52 adjoining exit ramp 50. The left and right rear surfaces 45 and 46 have a generally triangular plan configuration, and are steeply inclined downwardly from side edges 37 and 38 toward exit ramp 50, and serve to keep downed bowling pins from being knocked directly into the pinsetter. The left and right transition surfaces 47 and 48 extend between left and right rear surfaces 45 and 46 and forward surface 49, and also taper downwardly toward exit ramp 50. Top shell member 5 also includes a lower surface 52 (FIGS. 3 and 5) which is generally parallel to upper surface 6 to provide a uniform wall thickness, and selectively abuts bottom shell member 8, as described below.

It is to be understood that top shell member 5 may be formed in other configurations which also assist in conveying downed bowling pins 4 to the pinsetter. For example, exit ramp 50 could be formed coplanar with forward surface 49, such that surfaces 49 and 50 are inclined at the same downward angle, thereby eliminating the edge formed along rear side 52. Other similar variations are also contemplated by the present invention.

Figure 2:
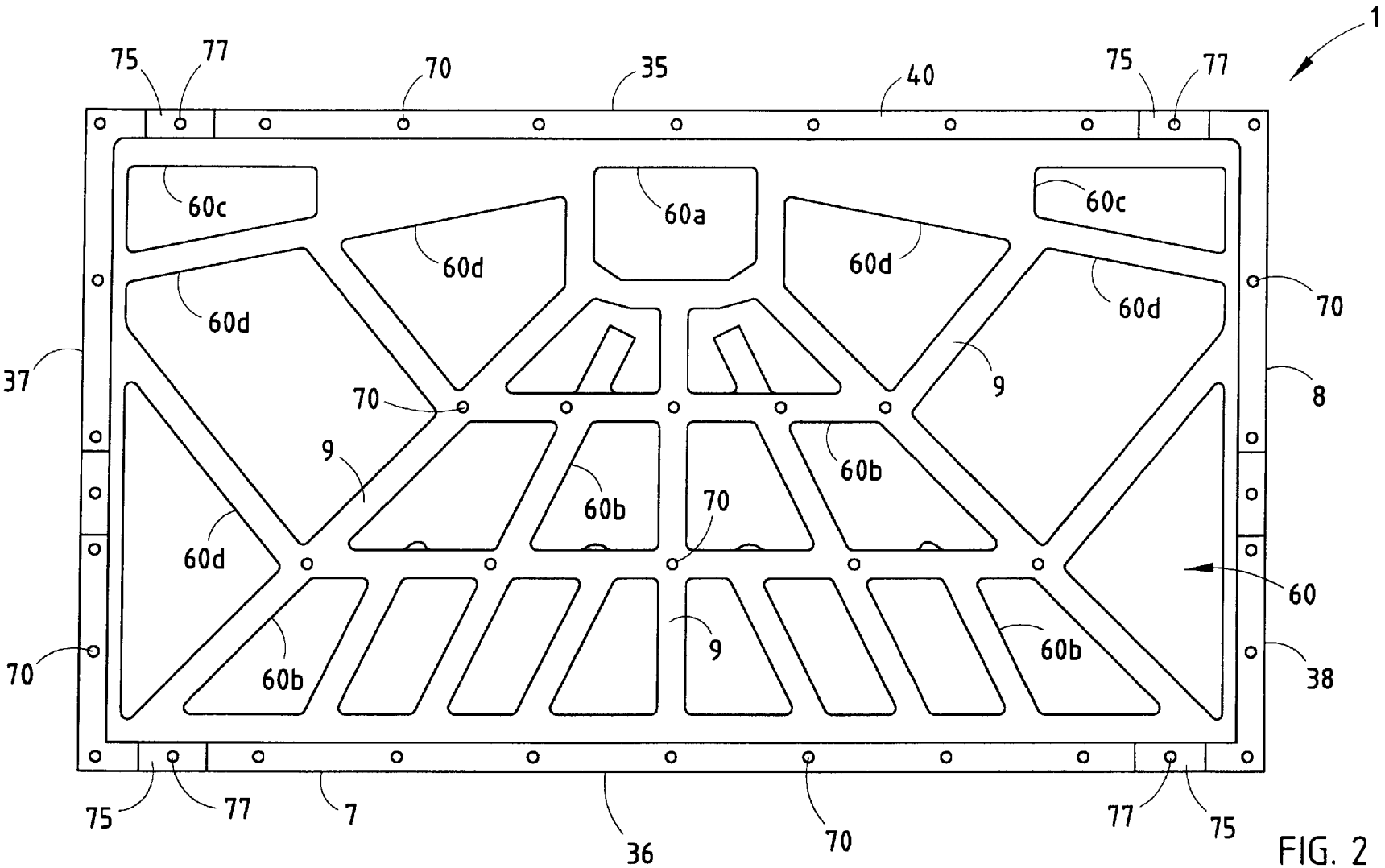
FIG. 2 is a bottom plan view of the pit board.

With reference to FIG. 2, the illustrated bottom shell member 8 includes a plurality of cup-shaped recesses 60 which define reinforcing ribs 9. As best illustrated in FIGS. 3 and 4, recesses 60 extend downwardly from the upper surface 61 of bottom shell member 8, and are cup or well-shaped, each being defined by an integral base 63 and upstanding sidewalls 64. With reference to FIGS. 2 and 5, recesses 60 include a central recess 60*a* that is positioned directly below exit ramp 50 on top shell member 5. In the illustrated example, recesses 60 are arranged in a radially extending pattern relative to central recess 68. More specifically, recesses 60*b* are positioned below the forward surface 49 of top shell member 5, recesses 60*c* are positioned directly below the left and right rear surfaces 45 and 46, and recesses 60*d* are positioned directly below left and right transition surfaces 47 and 48. Bottom shell member 8 also includes a lower surface 62 that is generally parallel to upper surface 61 to provide a uniform wall thickness.

In the illustrated example of pit board 1, top shell member 5 and bottom shell 8 are rigidly interconnected by a plurality of fasteners 70. With reference to FIG. 8, fasteners 70 extend vertically through mating apertures 71 in flanges 39 and 40 to securely interconnect the top and bottom shell members 5 and 8 along their peripheral edges. Furthermore, as shown in FIG. 1, fasteners 70 also interconnect the top and bottom shell members 5 and 8 in the forward surface portion 49 of pit board 1 where the lower surface 52 of top shell member 5 abuts the upper surface 61 of bottom shell member 8. Fasteners 70 may be provided in a wide variety of different shapes, sizes and styles, including conventional threaded fasteners, pop rivets, plastic rivets and the like. Furthermore, it is to be understood that the fasteners 70 also contemplate the use of adhesives, as well as ultrasonic welding, or other similar bonding means by which to connect top shell member 5 with bottom shell member 8 in the illustrated overlying relationship.

Pit board 1 also includes mounts 75 which attach pit board 1 directly to shaker mechanism 3 without any intermediate frame. In the illustrated example, four mounts 75 are provided in pit board 1 adjacent the corners thereof, and are in the form of inverted, U-shaped brackets 76 (FIG. 8) which are integrally formed in the flanges 39 and 40 of pit board 1. Each bracket 76 includes a vertically extending, centrally located fastener aperture 77 in which the upstanding stud 27 on an associated flexible mount 25 is received. The sides of formed brackets 76 are inclined similar to the side arms 28 of flexible mounts 24. Nuts 78 serve to securely attach pit board 1 to flexible mounts 25, yet permit pit board 1 to vibrate horizontally with respect to bottom pit conveyor frame 15.

Preferably, both top shell member 5 and bottom shell member 8 are molded from a synthetic resin material. The formed upper surface 6 of top shell member 5 and the reinforcing ribs 9 of bottom shell member 8 are preferably integrally formed during the molding process. The top and bottom shell members 5 and 8 may be manufactured by vacuum-forming imperforate sheets of synthetic resin material, or other similar methods, so as to create a relatively lightweight, but rigid, clamshell construction. Vacuum-forming, as well as other similar processes, permits the upper surface 6 of top shell member 5 to be contoured dramatically to assist in pin conveyance, without adding significant weight to pit board 1.

In operation, pit board 1 can be easily retrofitted to an existing pit conveyor assembly 2 by simply removing the existing top pit conveyor frame and associated board. Pit board 1 is then assembled onto the bottom pit conveyor frame by inserting the upstanding mounting studs 27 through the fastener apertures 77 in integral brackets 76 on pit board 1, and attaching nuts 78. Since pit board 1 is one-piece, substantial time and effort are saved in both assembling and disassembling the same with pit conveyor assembly 2. A new pit conveyor assembly 2 can be easily manufactured using a similar process.

When the pit conveyor assembly 2 needs to be cleaned and/or otherwise maintained, the operator can quickly and easily remove pit board 1 by simply detaching nuts 78 and removing pit board 1 for cleaning, and access to the underlying shaker mechanism 3. Pit board 1 is quickly and easily reattached to the shaker mechanism by reversing those steps described above.

Pit board 1 has a unique lightweight, clamshell construction that can be easily attached directly to an associated shaker mechanism without any intermediate frame, thereby reducing maintenance costs and effort, alleviating wear on moving parts, and reducing operating costs. The unique rigid, one-piece, clamshell construction also facilitates cleaning as well as handling.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. In a pit conveyor assembly for bowling alleys and the like of the type having a shaker mechanism to convey downed pins to an associated pinsetter, the improvement of a pit board, comprising:

a top shell member constructed from a synthetic resin material, and having a formed upper surface which is inclined downwardly toward a marginal portion thereof to convey downed pins to an adjacent pinsetter, and an outwardly projecting flange extending along a marginal edge thereof;

a bottom shell member constructed from a synthetic resin material, and having formed reinforcing ribs to rigidify said bottom shell member, and an outwardly projecting flange extending along a marginal edge thereof; said top shell member and said bottom shell member being fixedly interconnected in an overlying relationship by rigidly interconnecting said flange on said top shell member and said flange on said bottom shell member to provide a rigid, lightweight construction; and a mounting member connecting said pit board directly to said shaker mechanism without any intermediate frame.

2. A pit conveyor assembly as set forth in claim 1, wherein:

said top shell member and said bottom shell member comprise substantially imperforate formed sheets which when interconnected have an enclosed, one-piece, clamshell construction that alleviates dirt collection and facilitates cleaning.

3. A pit conveyor assembly as set forth in claim 2, wherein:

said bottom shell member includes an upper surface with a plurality of cup-shaped recesses therein which define said reinforcing ribs.

4. A pit conveyor assembly as set forth in claim 3, wherein:

said mounting member is positioned on at least one of said flanges of said top and bottom shell members.

5. A pit conveyor assembly as set forth in claim 4, wherein:

said upper surface of said top shell member includes inclined sidewall portions which slant downwardly to an exit ramp at said marginal portion of said top shell member.

6. A pit conveyor assembly as set forth in claim 5, wherein:

said top shell member includes a lower surface shaped to conform to the upper surface of said bottom shell member.

7. A pit conveyor assembly as set forth in claim 6, wherein:

said bottom shell member includes a central one of said recesses disposed generally below said exit ramp on said top shell member.

8. A pit conveyor assembly as set forth in claim 7, wherein:

said recesses are arranged in a radially extending pattern relative to said central recess.

9. A pit conveyor assembly as set forth in claim 8, wherein:

said upper surface of said bottom shell member disposed between adjacent recesses is connected with the bottom surface of said top shell member.

10. A pit conveyor assembly as set forth in claim 9, wherein:

said top and bottom shell members are constructed from vacuum-formed plastic.

11. A pit conveyor assembly as set forth in claim 10, wherein:

said mounting member comprises at least one mounting aperture in said pit board configured to receive a fastener therein.

12. A pit conveyor assembly as set forth in claim 11, wherein:

said mounting aperture comprises a hole extending vertically through said flanges in said top and bottom shell members.

13. A pit conveyor as set forth in claim 12, wherein:

said shaker mechanism comprises a vibrator.

14. A pit conveyor assembly as set forth in claim 1, wherein:

said bottom shell member includes an upper surface with a plurality of cup-shaped recesses therein which define said reinforcing ribs.

15. A pit conveyor assembly as set forth in claim 1, wherein:

said upper surface of said top shell member includes inclined sidewall portions which slant downwardly to an exit ramp at said marginal portion of said top shell member.

16. A pit conveyor assembly as set forth in claim 1, wherein:

said top and bottom shell members are constructed from vacuum-formed plastic.

17. A pit conveyor assembly as set forth in claim 1, wherein:

said mounting member comprises at least one mounting aperture in said pit board configured to receive a fastener therein.

18. A pit board for bowling alleys and the like of the type having a pit conveyor assembly with a shaker mechanism to convey downed pins to an associated pinsetter, comprising:

a top shell member constructed from a synthetic resin material, and having a formed upper surface which is inclined downwardly toward a marginal portion thereof to convey downed pins to an adjacent pinsetter, and an outwardly projecting flange extending along a marginal edge thereof;

a bottom shell member constructed from a synthetic resin material, and having formed reinforcing ribs to rigidify said bottom shell member, and an outwardly projecting flange extending along a marginal edge thereof; said top shell member and said bottom shell member being fixedly interconnected in an overlying relationship by rigidly interconnecting said flange on said top shell member with said flange on said bottom shell member to provide a rigid, lightweight construction; and a mounting member configured for connecting said pit board directly to the shaker mechanism without any intermediate frame.

19. A pit board as set forth in claim 18, wherein:

said top shell member and said bottom shell member comprise substantially imperforate formed sheets which when interconnected have an enclosed, one-piece, clamshell construction that alleviates dirt collection and facilitates cleaning.

20. A pit board as set forth in claim 19, wherein:

said bottom shell member includes an upper surface with a plurality of cup-shaped recesses therein which define said reinforcing ribs.

21. A pit board as set forth in claim 20, wherein:

said mounting member is positioned on at least one of said flanges of said top and bottom shell members.

22. A pit board as set forth in claim 21, wherein:

said upper surface of said top shell member includes inclined sidewall portions which slant downwardly to an exit ramp at said marginal portion of said top shell member.

23. A pit board as set forth in claim 22, wherein:

said top shell member includes a lower surface shaped to conform to the upper surface of said bottom shell member.

24. A pit board as set forth in claim 23, wherein:

said bottom shell member includes a central one of said recesses disposed generally below said exit ramp on said top shell member.

25. A pit board as set forth in claim 24, wherein:

said recesses are arranged in a radially extending pattern relative to said central recess.

26. A pit board as set forth in claim 25, wherein:

said upper surface of said bottom shell member disposed between adjacent recesses is connected with the bottom surface of said top shell member.

27. A pit board as set forth in claim 26, wherein:

said top and bottom shell members are constructed from vacuum-formed plastic.

28. A pit board as set forth in claim 27, wherein:

said mounting member comprises at least one mounting aperture in said pit board configured to receive a fastener therein.

29. A method for making a pit conveyor assembly for bowling alleys and the like of the type having a shaker mechanism to convey downed pins to an associated pinsetter, comprising:

molding from a synthetic resin material a top shell member by forming an upper surface which is inclined downwardly toward a marginal portion thereof to convey downed pins to an adjacent pinsetter;

molding from a synthetic resin material a bottom shell member by forming reinforcing ribs to rigidify the bottom shell member;

rigidly connecting the top shell member with the bottom shell member in an overlying relationship to form a rigid, lightweight, one-piece, frameless pit board; and attaching the pit board directly to the shaker mechanism without any intermediate frame.

30. A method as set forth in claim 29, wherein:

said top and bottom shell molding steps comprise forming the top and bottom shell members from substantially imperforate sheets; and said connecting step comprises interconnecting marginal portions of the top and bottom shell members to provide an enclosed, one-piece, clamshell construction that alleviates dirt collection and facilitates cleaning.

31. A method as set forth in claim 30, wherein:

said bottom shell molding step includes forming a plurality of cup-shaped recesses in the upper surface thereof to create the reinforcing ribs.

32. A method as set forth in claim 31, wherein:

said top shell molding step includes forming an outwardly projecting flange extending along a marginal edge thereof;

said bottom shell molding step includes forming an outwardly projecting flange extending along a marginal edge thereof; and said connecting step comprises fixedly connecting the flanges on the top and bottom shell members.

33. A method as set forth in claim 32, wherein:

said top and bottom shell molding steps comprise vacuum-forming plastic.

34. A method for making a pit board for bowling alleys and the like of the type having a pit conveyor assembly with a shaker mechanism to convey downed pins to an associated pinsetter, comprising:

molding from a synthetic resin material a top shell member by forming an upper surface which is inclined downwardly toward a marginal portion thereof to convey downed pins to an adjacent pinsetter, and forming an outwardly projecting flange along a marginal edge thereof;

molding from a synthetic resin material al bottom shell member by forming reinforcing ribs to rigidify the bottom shell member, and forming an outwardly projecting flange along a marginal edge thereof;

rigidly connecting the top shell member with the bottom shell member in an overlying relationship by fixedly connecting the flanges on the top and bottom shell members to create a rigid, lightweight, clamshell construction; and forming a mounting member configured for attaching the pit board directly to the shaker mechanism without any intermediate frame.

35. A method as set forth in claim 34, wherein:

said top and bottom shell molding steps comprise forming the top and bottom shell members from substantially imperforate sheets.

36. A method as set forth in claim 35, wherein:

said bottom shell molding step includes forming a plurality of cup-shaped recesses in the upper surface thereof to create the reinforcing ribs.

37. A method as set forth in claim 36, wherein:

said top and bottom shell molding steps comprise vacuum-forming plastic.

38. A method as set forth in claim 29, wherein:

said bottom shell molding step includes forming a plurality of cup-shaped recesses in the upper surface thereof to create the reinforcing ribs.

39. A method as set forth in claim 29, wherein:

said top and bottom shell molding steps comprise vacuum-forming plastic.

* * * * *

UNITED STATES PATENT AND TRADEMARK OFFICE

CERTIFICATE OF CORRECTION

PATENT NO. : 6,537,157 B1
DATED : March 25, 2003
INVENTOR(S) : Edward J. Dziura et al.

It is certified that error appears in the above-identified patent and that said Letters Patent is hereby corrected as shown below:

Column 3,
Line 12, "III III" should be -- III-III --.
Line 14, "IV IV" should be -- IV-IV --.
Line 16, "VV" should be -- V-V --.
Line 54, delete "all)".

Column 10,
Line 5, "al" should be -- a --.

Signed and Sealed this

Twenty-ninth Day of July, 2003

JAMES E. ROGAN
*Director of the United States Patent and Trademark Office*